US012534984B2

(12) United States Patent
Hoelscher et al.

(10) Patent No.: US 12,534,984 B2
(45) Date of Patent: Jan. 27, 2026

(54) WELL TOOL HAVING AN AUTONOMOUS BALLISIC ARMING MECHANISM

(71) Applicant: Halliburton Energy Services, Inc., Houston, TX (US)

(72) Inventors: Christopher C. Hoelscher, Alvarado, TX (US); Kevin Cook, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/355,778

(22) Filed: Jul. 20, 2023

(65) Prior Publication Data

US 2025/0027390 A1 Jan. 23, 2025

(51) Int. Cl.
*E21B 43/1185* (2006.01)
*E21B 23/04* (2006.01)

(52) U.S. Cl.
CPC ..... *E21B 43/1185* (2013.01); *E21B 23/0414* (2020.05)

(58) Field of Classification Search
CPC ..... E21B 43/1185; E21B 43/11852; E21B 43/11853; E21B 23/04; E21B 23/0414
See application file for complete search history.

(56) References Cited

U.S. PATENT DOCUMENTS 5,027,708 A 7/1991 Gonzalez et al.
9,157,718 B2 * 10/2015 Ross ..... E21B 43/1185
10,077,641 B2 9/2018 Rogman et al.
11,480,038 B2 10/2022 Eitschberger
11,486,234 B2 11/2022 Macgilllivray
11,608,720 B2 3/2023 Preiss et al.
11,624,266 B2 4/2023 Mauldin et al.
2011/0024104 A1 * 2/2011 Griffiths ..... H01R 13/521 439/190
2012/0247771 A1 10/2012 Black et al.
2015/0330192 A1 11/2015 Rogman et al.
2020/0332630 A1 * 10/2020 Davis ..... E21B 43/11855
2022/0074723 A1 3/2022 Leclair et al.
2022/0145732 A1 5/2022 Anthony et al.
2023/0023338 A1 1/2023 Eitschberger et al.

OTHER PUBLICATIONS

"PCT Application No. PCT/US2023/070779, International Search Report and Written Opinion", Mar. 29, 2024, 11 pages.

* cited by examiner

*Primary Examiner* — D. Andrews
(74) *Attorney, Agent, or Firm* — DeLizio, Peacock, Lewin & Guerra LLP

(57) ABSTRACT

Systems, methods, and apparatus including an autonomous ballistic arming mechanism that may be used in well systems. A first well tool may include an initiating device, and a ballistic barrier housing the initiating device. The ballistic barrier may be configured to mechanically move when the first well tool is engaged with a second well tool to position the initiating device for ballistically arming the first well tool. The first well tool may be a first perforating gun system, the second well tool may be a second perforating gun system, and the initiating device may be a detonator. The ballistic barrier may mechanically move to align the initiating device with a detonating cord of the second well tool for ballistically arming the first well tool.

23 Claims, 8 Drawing Sheets

WELL TOOL HAVING AN AUTONOMOUS BALLISIC ARMING MECHANISM

TECHNICAL FIELD

The present invention relates generally to oil and gas systems and services, and more specifically to a well tool having an autonomous ballistic arming mechanism.

BACKGROUND

The oil and gas services industry uses several types of well systems for oil and gas exploration and production (E&P) operations, such as drilling, production, and completion well systems. The oil and gas services industry uses various types of downhole well tools and devices. The downhole well tools and devices perform various functions for the well system. For example, for fracturing operations, the well system may utilize perforating gun systems to create various perforations in a casing of a wellbore by detonating various charges within the perforating gun systems. Typically, the detonators of the perforating gun systems are shipped separately from the rest of the perforating gun system to prevent any accidental detonation of the charges within the perforating gun system during shipping, handling, and storage. Since the detonators are shipped and packaged separately from the perforating gun systems, the perforating gun systems are typically loaded with the detonators at the well site. Shipping and packaging the detonators separately than the rest of the perforating gun system adds cost to the packaging, shipping, handling, and storage. Also, loading the detonators manually at the well site can introduce accidental detonation risks to the well site personnel.

DESCRIPTION

The description that follows includes example systems, methods, techniques, and program flows that describe aspects of the disclosure. However, it is understood that this disclosure may be practiced without these specific details. For instance, this disclosure refers to reservoir modeling in illustrative examples. Aspects of this disclosure can be instead applied to other types of models involving spatiotemporal datasets. In other instances, well-known instruction instances, protocols, structures, and techniques have not been shown in detail to avoid confusion.

Figure 1:
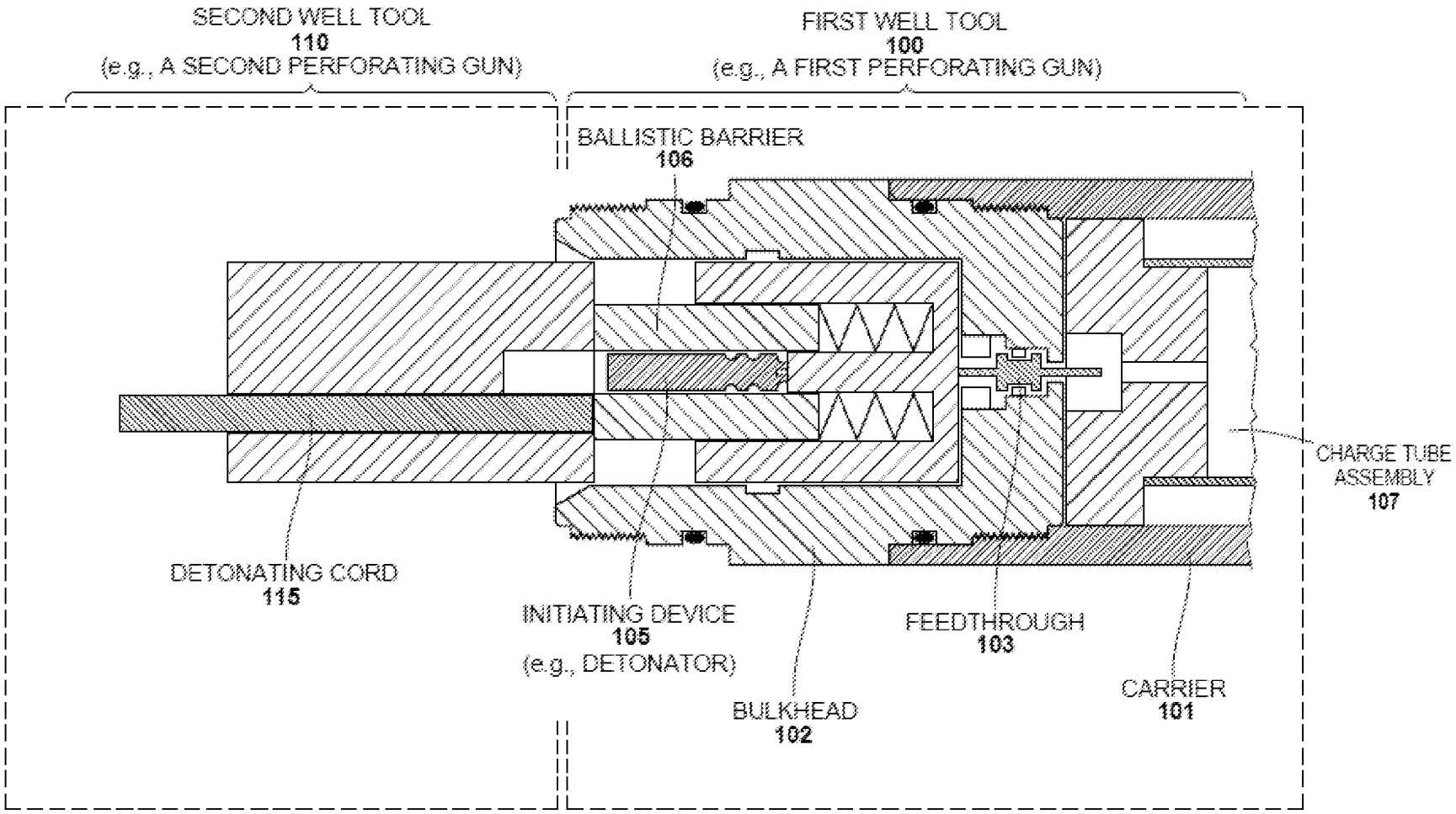
FIG. 1 depicts a schematic diagram of an example well tool including an autonomous ballistic arming mechanism, according to some implementations.

FIG. 1 depicts a schematic diagram of an example well tool including an autonomous ballistic arming mechanism. The well tool may be used in well systems in the oil and gas services industry for various operations, such as fracturing operations, as further described in FIG. 8. In some implementations, a first well tool 100 may include an initiating device 105 and a ballistic barrier 106. The ballistic barrier 106 may also be referred to as a protective barrier or sleeve, an isolation barrier or sleeve, a ballistic sleeve, or a ballistic sleeve, among others. In some implementations, the initiating device 105 may be a detonator, an igniter, an initiator, a blasting cap, or other device that provides the initiation of an explosive detonation or ignition. In some implementations, the initiating device 105, the ballistic barrier 106, and any mechanical means (e.g., such as springs) that allow the ballistic barrier 106 to mechanically move to position the initiating device 105 for ballistically arming the first well tool 100 may be referred to as the autonomous ballistic arming mechanism. In some implementations, the first well tool 100 may be a perforating gun system, as shown in the example of FIG. 1 and described further below. It is noted, however, that in other implementations the first well tool 100 may be a connection tool for another tool (such as a connecting tool or isolation sub for a setting tool), an igniter tool for another tool (such as an igniter tool for a setting tool), or a different tool besides a perforating gun system (such as a setting tool), among others. FIG. 1 also depicts part of a second well tool 110 that is being engaged or mated with the first well tool 100, as further described below. The second well tool 110 may include a detonating cord 115. In some implementations, the second well tool 110 may be a second perforating gun system. It is noted, however, that in other implementations the second well tool 110 may be another well tool or device, such as a connection tool for the drill string (e.g., a connection tool for connecting the perforating gun systems or the bottom hole assembly to the drill string), among others. In some implementations, the first well tool 100 may be engaged or mated with the second well tool 110 to ballistically arm the tool, as further described below.

In some implementations, the ballistic barrier 106 allows the initiating device 105 to be installed in the first well tool 100 without it being ballistically armed until a deliberate action is performed by a user. The deliberate action performed by the user may be engaging or mating the first well tool 100 with a second well tool 110 (which may be referred to as tool-to-tool engagement or mating) to ballistically arm the first well tool 100. The ballistic barrier 106 that houses or covers or protects the initiating device 105 may provide an interruption barrier for a detonation path for the first well tool 100. The ballistic barrier 106 may also provide an interruption barrier for an electrical path or an electrical circuit for the first well tool 100. The deliberate action of engaging or mating the first well tool 100 with the second well tool 110 may automatically remove the ballistic barrier 106 from the detonation path (and, optionally, from the electrical path or electrical circuit). In some implementations, when the first well tool 100 is engaged or mated with the second well tool 110, the ballistic barrier 106 is mechanically moved to position the initiating device 105 for ballistically arming the first well tool 100. For example, when the first well tool 100 is engaged or mated with the second well tool 110, the ballistic barrier 106 is mechanically moved to align the initiating device 105 of the first well tool 100 with the detonating cord 115 of the second well tool 110 for ballistically arming the first well tool 100. In some implementations, the mechanical motion or movement of the ballistic barrier 106 to ballistically arm the system is also reversible by disconnecting the tools.

In some implementations, the first well tool 100 is engaged, mated, connected to the second well tool 110 using a threaded connection end to end. It is noted, however, that other types of connections may be used. In some implementations, the ballistic barrier 106 is mechanically moved by compression or rotation of the ballistic barrier 106 when the first well tool 100 is connected with the second well tool 110. It is noted that the mechanical movement of the ballistic barrier 106 may be other types of movements, such as a retraction motion or a sliding action, among others, as further described below. In some implementations, the engagement or mating or connection of the first well tool 100 and the second well tool 110 may provide a double arming action that are autonomous by reaction of the connection of the tools. In some implementations, the ballistic barrier 106 may be designed with material properties that block a detonation transmission, including sympathetic transmission from shock wave, spalling, and flyer plate modes of detonation, among others. In some implementations, the ballistic barrier 106 may be composed of one or more of plastics, metal, gas, paper, and composite of these materials so that the shock from the initiating device 105 is at least partially absorbed and attenuated. For example, the shock may be partially absorbed and attenuated such that the shock is not transmitted into the receiver end (such as a detonating cord in the receiver end), which can propagate the detonation. In some implementations, the materials that form the ballistic barrier 106 may include a solid material that has strength properties to resist the pressure produced by the initiating device 105. For example, metals, plastics, or polymers that have a certain impact toughness may be used as materials for the ballistic barrier 106. For example, steels having an impact toughness in the range of 20 ft-lb to 175 ft-lb, and polymers having an impact toughness in the range of 20 $J/m^2$ to 400 $J/m^2$ may be used as materials for the ballistic barrier 106. It is noted that in some designs a material that is too hard or too brittle may transmit shock or spall to create a sympathetic initiation of the detonating cord 115. In some implementations, the ballistic barrier 106 may also be comprised of more than one material such that a harder material resists the load impact of fragments and pressure, while another material absorbs the energy such that it is not transmitted through the ballistic barrier 106 to the detonating cord 115.

In some implementations, when the first well tool 100 is engaged with the second well tool 110, the components that are compressed or rotated to align the initiating device 105 may be located in first well tool 100 (e.g., such as the initiating device 105 and the ballistic barrier 106), may be located in the second well tool 110 (e.g., such as the detonating cord 115), or in both the first well tool 100 and the second well tool 110. In some implementations, the first well tool 100 may include an electrical barrier (e.g., such as a connection or shunt) to provide further electrical arming and disarming. For example, the first well tool 100 may include an electrical shunt that prevents any power or electrical signals from being transmitted until the first well tool 100 is connected to the second well tool 110. As described above, in one example, the electrical barrier (which may be separate from or part of the ballistic barrier 106) may include connections that align and allow the transmission of power and electrical signals when the two well tools are connected or mated together. In some implementations, in between the carrier or assembly (having the initiating element 105, the charge tube assembly 107, etc.) and the housing or outer shell of the first well tool 100, the first well tool 100 may include bearings that enable the free rotation of the carrier or assembly about the primary axis of the first well tool 100. For example, the bearing can help orient the charges of the charge tube assembly 107 in a desired direction using gravity.

In some implementations, the ballistic barrier 106 provides a protective barrier that allows the initiating device 105 to be installed in the first well tool 100 during shipping and handling, even if the first well tool 100 also has explosive components. The ballistic barrier 106 may house the initiating device 105 and protect it from incidental damage or impact prior to arming. The initiating device 105 as housed by the ballistic barrier 106 may be assembled into the first well tool 100 during manufacturer assembly and shipped as assembled. The integration of all the explosive components may eliminate the separate shipping, storage, and handling of the initiating device 105 (e.g., such as a detonator) and the first well tool 100 (e.g., such as a perforating gun system), which reduces cost of separate shipping, storage, and handling of these components. By integrating all the explosive components, the packaging of the initiating devices and the associated resources are no longer necessary along with the well site footprint and waste for the separate packaging. Also, the burdens of administrative activities may be reduced by the integration of the explosive components into a single assembly and packaging.

In some implementations, when the first well tool 100 is a first perforating gun system 100, the first perforating gun system may include a carrier 101, a bulkhead 102, a feedthrough 103, an initiating device 105, a ballistic barrier 106, and a charge tube assembly 107. Although not shown in FIG. 1 for simplicity, the charge tube assembly 107 may include one or more charges, and the first perforating gun system 100 may also include a detonator cord. In some implementations, the second well tool 110 is a second perforating gun system 110 that is being engaged or mated with the first perforating gun system 100, as further described below. The second perforating gun system may include the detonating cord 115. Although not shown in FIG. 1 for simplicity, similar to the first perforating gun system, the second perforating gun system may include a carrier, a bulkhead, a feedthrough, an initiating device, a ballistic barrier, and a charge tube assembly having one or more charges. As described previously, in some implementations, the device that is being engaged or mated with the first perforating gun system may be another well device or tool that is not a perforating gun system, such as a connection tool for the drill string (e.g., a connection tool for connecting the perforating gun systems or the bottom hole assembly to the drill string), or an isolation sub, among others. In some implementations, the first perforating gun system may be engaged or mated with the second perforating gun system to ballistically arm the system, as further described below.

In some implementations, when the first well tool 100 is a first perforating gun system, the initiating device 105 may be a detonator. The ballistic barrier 106 allows the detonator to be installed in the first perforating gun system without it being ballistically armed until a deliberate action is performed by a user. The deliberate action performed by the user may be engaging or mating the first perforating gun system with the second perforating gun system. This may be referred to as a tool-to-tool or gun-to-gun engagement or mating to ballistically arm the system. The ballistic barrier 106 that houses or covers or protects the detonator may provide an interruption barrier for a detonation path, which may include one or more charges and the detonator cord. The ballistic barrier 106 may also provide an interruption barrier for an electrical path or an electrical circuit for the first perforating gun system. For example, the electrical path or electrical circuit may be the electrical means for communication with the wireline communication system of the well system, which, for example, may provide electrical signals to trigger the detonation.

In some implementations, engaging or mating the first perforating gun system with the second perforating gun system may automatically remove the ballistic barrier 106 from the detonation path. In some implementations, when the first perforating gun system is engaged or mated with the second perforating gun system, the ballistic barrier 106 is mechanically moved to position the detonator for ballistically arming the first perforating gun system. For example, when the first perforating gun system is engaged or mated with the second perforating gun system, the ballistic barrier 106 is mechanically moved to align the detonator of the first perforating gun system with the detonating cord 115 of the second perforating gun system for ballistically arming the system. In some implementations, the mechanical motion or movement of the ballistic barrier 106 to ballistically arm the system is also reversible by disconnecting the perforating guns. In some implementations, engaging or mating the first perforating gun system with the second perforating gun system may, optionally, also remove the ballistic barrier 106 from blocking the electrical path or electrical circuit (e.g., such as the electrical path or circuit that connections to the wireline communication system of the well system).

In some implementations, the first perforating gun system is engaged, mated, connected to the second perforating gun system using a threaded connection end to end. The detonator housing may be internal to the main outer body of the first perforating gun system and engages after the two perforating gun systems are engaged by sufficient connection to provide full enclosure of the explosives. In some implementations, the ballistic barrier 106 is mechanically moved by compression or rotation of the ballistic barrier 106 when the first well tool 100 is connected with the second well tool 110. The ballistic barrier 106 may have a feature that moves the ballistic barrier 106 out of the detonator train and moves the detonator into the detonator train by a compression or rotation of the ballistic barrier 106 during the engagement with the second perforating gun system. The ballistic barrier 106 may be compressed or rotated independently by the action of inserting or mating the housing within the gun body of the second perforating gun system that holds the detonating cord. It is noted that the mechanical movement of the ballistic barrier 106 may be other types of movements, such as a retraction motion or a sliding action, among others, as further described below. In some implementations, the engagement or mating or connection of the first perforating gun system and the second perforating gun system may provide a double arming action that are autonomous by reaction of the connection of the tools.

The first well tool 100 (e.g., such as a perforating gun system) housing the initiating device 105 (e.g., such as a detonator) within a ballistic barrier that mechanically moves when the first well tool 100 is engaged or mated with a second well tool to position the initiating device 105 for ballistically arming the first well tool 100 may result in the following improvements and advantages: (1) gained efficiency in shipping and handling of explosive components in a safe, single perforating gun system; (2) the autonomous arming system for initiating devices to explosive components; (3) enhance safety and risk reduction in the handling of explosive components; (4) eliminates separate shipping, storage, and handling of detonators, charges and loaded guns; (5) reduces costs in shipping and storage; (6) reduces packaging and waste; (7) reduces footprint in storage and wellsite; (8) eliminates the traditional gun loading trailer or facility at wellsite; (9) reduces administrative tasks for explosive records and transactions; (10) removes the human personnel risk of arming devices; (11) reduces manufacturing and assembling by integrating into a single shipping assembly; (12) increases the operational efficiencies by eliminating the tasks of shipping detonators, staging detonators, and installing detonators; and (13) increases the speed of the perforating operation by removing personnel tasks at wellsite.

Figure 2:
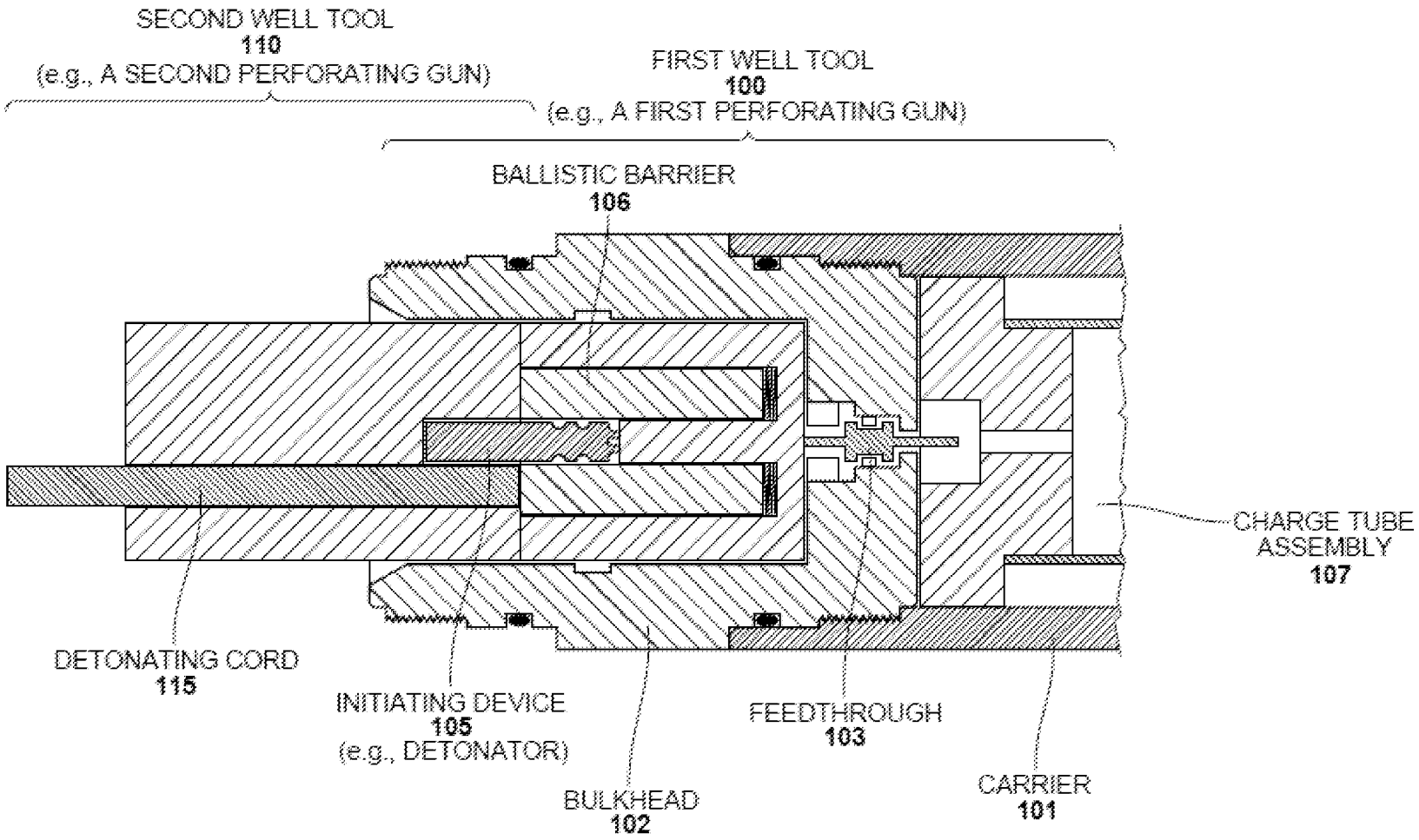
FIG. 2 depicts a schematic diagram of an example first well tool that is engaged or mated with a second well tool and ballistically armed, according to some implementations.

FIG. 2 depicts a schematic diagram of an example first well tool 100 that is engaged or mated with a second well tool 110 and ballistically armed. FIG. 2 shows the first well tool 100 and the second well tool 110 in a ballistically armed position. As described with reference to FIG. 1, when the first well tool 100 and the second well tool 110 are engaged or connected or mated, the ballistic barrier 106 may mechanically move to position the initiating device 105 in a position that aligns with the detonating cord 115, which opens the detonation path and ballistically arms the tool. FIG. 2 shows the ballistic barrier 106 in a retracted position and the initiating device 105 aligned with the detonating cord 115. As described in FIG. 1, the ballistic barrier 106 may be compressed or rotated (or may be designed to be mechanically moved in various other ways) to align the initiating device 105 with the detonating cord 115 when the first well tool 100 is engaged or connected or mated with the second well tool 110.

Figure 3A:
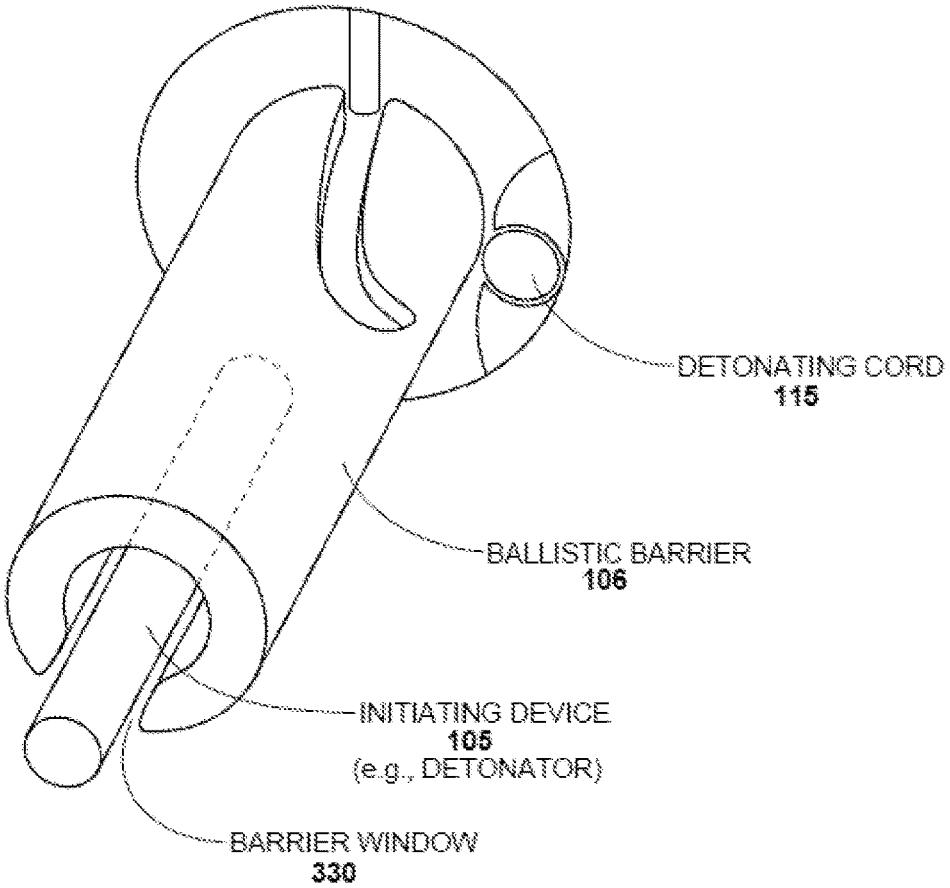
FIG. 3A depicts a schematic diagram of an example ballistic barrier that rotates for alignment of the initiating device when a first well tool is engaged with a second well tool, according to some implementations.

FIG. 3A depicts a schematic diagram of an example ballistic barrier 106 that rotates for alignment of the initiating device 105 when a first well tool (such as the first well tool 100) is engaged with a second well tool (such as the second well tool 110). In some implementations, the pin and a slot feature shown in FIG. 3 may allow the ballistic barrier 106 to rotate. For example, the ballistic barrier 106 may include the slot feature and the receiving end of the second well tool may include the pin feature, and thus as the first well tool is engaged with the second well tool, the movement of the pin along the slot as the tools move closer together (e.g., as the tools are threaded together) may cause the ballistic barrier 106 to rotate. In some implementations, the ballistic barrier 106 that houses the initiating device 105 may surround or cover the initiating device 105, except for a barrier window 330. The ballistic barrier 106 may rotate to position the barrier window 330 having an opening to the initiating device 105 such that the initiating device 105 is aligned with the detonating cord 115. For example, the initiating device 105 may come in contact with the detonating cord 115 or may be positioned next to, or at close proximity to, the detonating cord 115 such that the detonation path is opened. In some implementations, instead of the pin and slot feature, the ballistic barrier 106 may include springs and the ballistic barrier 106 may retract as it is compressed or rotated in order to align the initiating device 105 with the detonating cord 115. It is noted, however, that the ballistic barrier 106 may function and mechanically move in various other ways to align the initiating device 105 with the detonating cord 115.

Figure 3B:
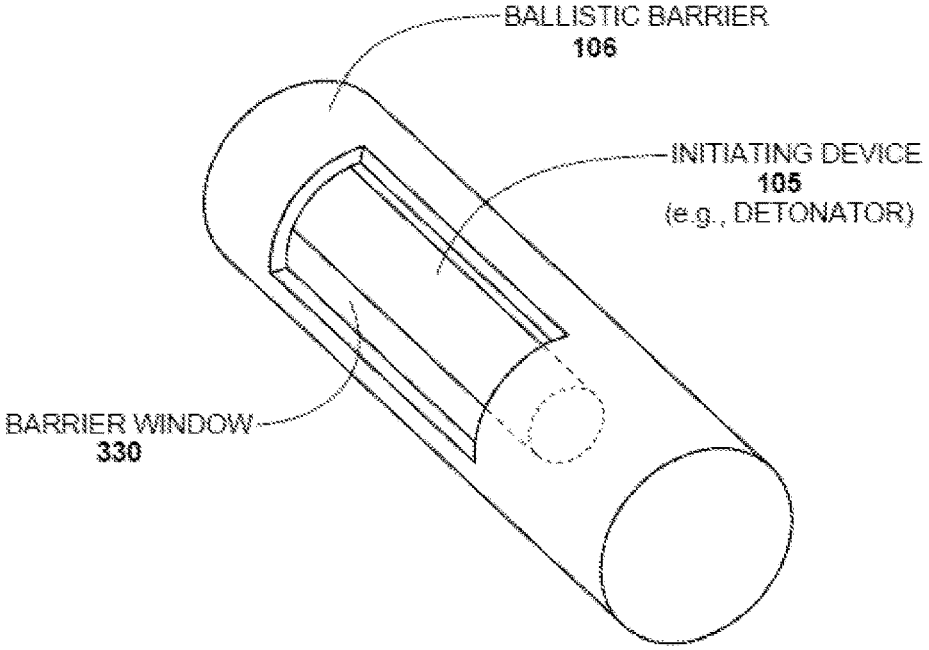
FIG. 3B depicts a schematic diagram of an example ballistic barrier having a barrier window, according to some implementations.

FIG. 3B depicts a schematic diagram of an example ballistic barrier 106 having a barrier window 330. In some implementations, the ballistic barrier 106 that houses the initiating device 105 may have a barrier window 330 that may position the initiating device 105 for ballistically arming the first well tool. As shown in FIG. 3, the ballistic barrier 106 may surround or cover the initiating device 105 except for barrier window 330. When the first well tool is engaged with the second well tool, the ballistic barrier 106 may mechanically move to align the initiating device 105 with the detonating cord (such as detonating cord 115) via the barrier window 330. For example, the barrier window 330 may rotate to a position that is between the initiating device 105 and the detonating cord in order to align the initiating device 105 with the detonating cord, open up the detonation path, and ballistically arm the tool.

Figure 4:
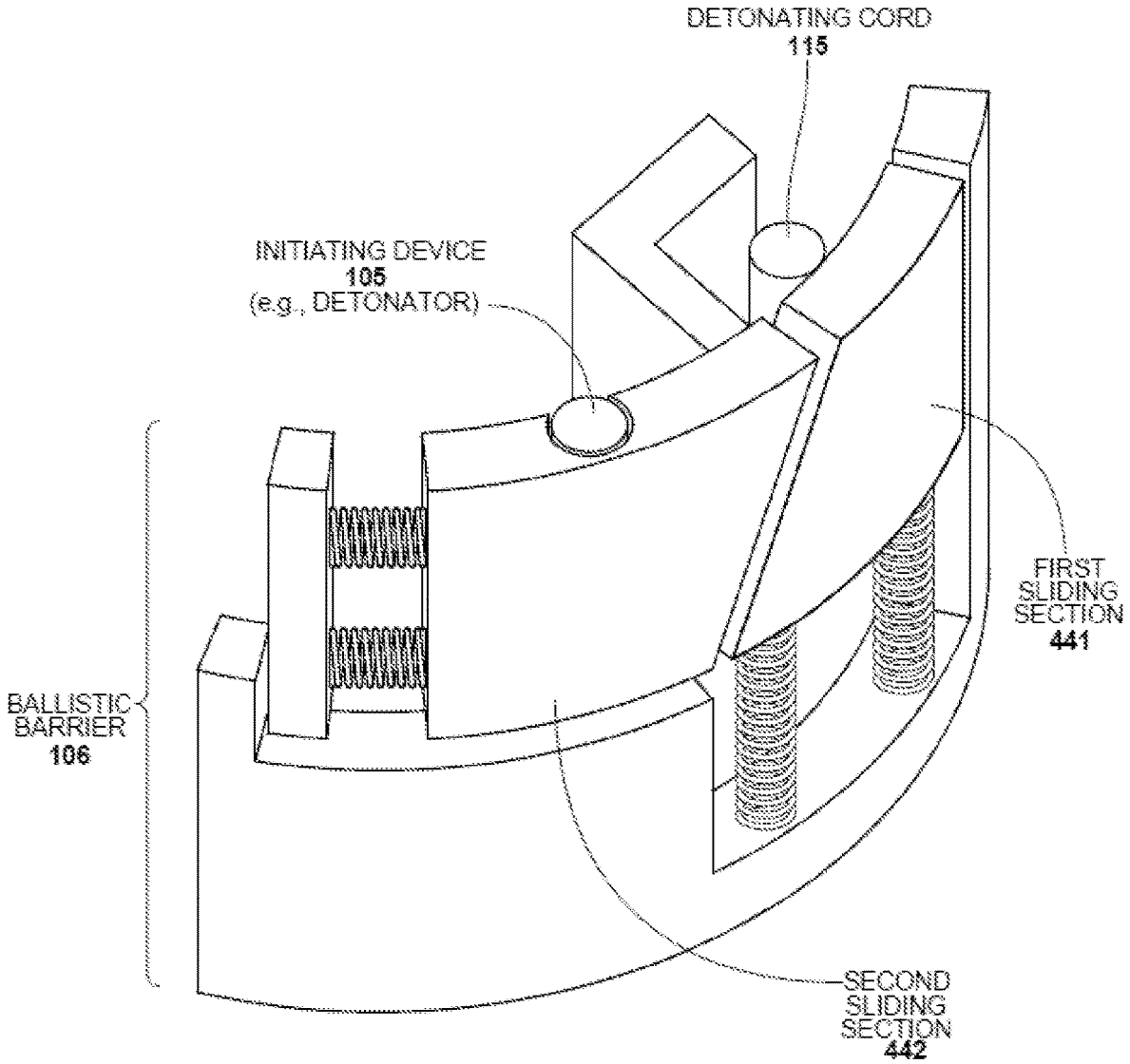
FIG. 4 depicts a schematic diagram of an example ballistic barrier that slides for alignment of the initiating device when a first well tool is engaged with a second well tool, according to some implementations.

FIG. 4 depicts a schematic diagram of an example ballistic barrier 106 that slides for alignment of the initiating device 105 when a first well tool (e.g., such as the first well tool 100) is engaged with a second well tool (e.g., such as the second well tool 110). In some implementations, the spring-loaded slide mechanism shown in FIG. 4 may allow the ballistic barrier 106 to slide. For example, the ballistic barrier 106 may include a first sliding section 441 having one or more springs and a second sliding section 442 having one or more springs. As the first well tool is engaged with the second well tool, the first sliding section 441 may be pushed down (and the springs of the first sliding section 441 may be compressed), which causes the second sliding section 442 that has compressed springs to slide into the gap created when the first sliding section 441 moved down. As shown in FIG. 4, the second sliding section 442 of the ballistic barrier 106 may house or cover the initiating device 105 (e.g., such as a detonator), except for one side of the initiating device 105 which may be uncovered or the second sliding section 442 may have a barrier window where the initiating device 105 is uncovered. Also, as shown in FIG. 4, when the first well tool is engaged with the second well tool, the detonating cord 115 may be positioned behind the first sliding section 441. Thus, when the second sliding section 442 slides into the gap created when the first sliding section 441 moves down, the initiating device 105 may be aligned with the detonating cord 115 for ballistically arming the first well tool. For example, the initiating device 105 may come in contact with the detonating cord 115 or may be positioned next to, or at close proximity to, the detonating cord 115 such that the detonation path is opened. It is noted, however, that in some implementations the mechanism may be reversed and the detonating cord may be positioned within the second sliding section 442 and the initiating device 105 may be positioned behind the first sliding section 441. It is noted, however, that the ballistic barrier 106 may function and mechanically move in various other ways to align the initiating device 105 with the detonating cord 115.

Figure 5:
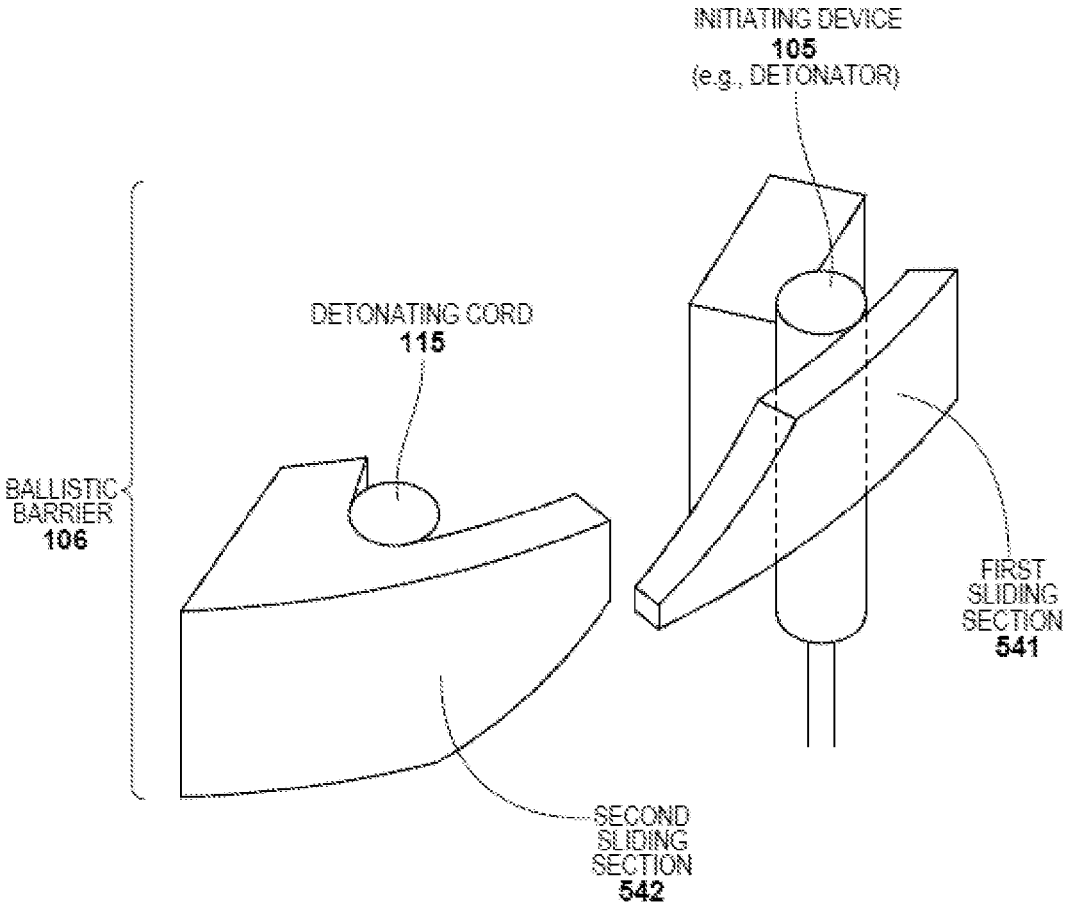
FIG. 5 depicts a schematic diagram of another example ballistic barrier that slides for alignment of the initiating device when a first well tool is engaged with a second well tool, according to some implementations.

FIG. 5 depicts a schematic diagram of another example ballistic barrier 106 that slides for alignment of the initiating device 105 when a first well tool (e.g., such as the first well tool 100) is engaged with a second well tool (e.g., such as the second well tool 110). In some implementations, the ramp and slide mechanism shown in FIG. 5 may allow the ballistic barrier 106 to slide. For example, as the first well tool is engaged with the second well tool, the second sliding section 542 is moved toward the first sliding section 541, and the second sliding section 542 may move or slide over the ramp-like end of the first sliding section 541 and push down the first sliding section 541. When the first sliding section 541 is pushed down, the second sliding section 542 may continue to slide over the first sliding section 541 until the initiating device 105 is aligned with the detonating cord 115. As shown in FIG. 5, the first sliding section 542 of the ballistic barrier 106 may house or cover the initiating device 105 (e.g., such as a detonator), and when the first sliding section 542 is moved down by the second sliding section 542, one side of the initiating device 105 may be uncovered and aligned with the detonating cord 115. For example, the initiating device 105 may come in contact with the detonating cord 115 or may be positioned next to, or at close proximity to, the detonating cord 115 such that the detonation path is opened. It is noted, however, that in some implementations the mechanism may be reversed and the detonating cord may be positioned within the first sliding section 541 and the initiating device 105 may be positioned within the second sliding section 542. It is noted, however, that the ballistic barrier 106 may function and mechanically move in various other ways to align the initiating device 105 with the detonating cord 115.

Figure 6:
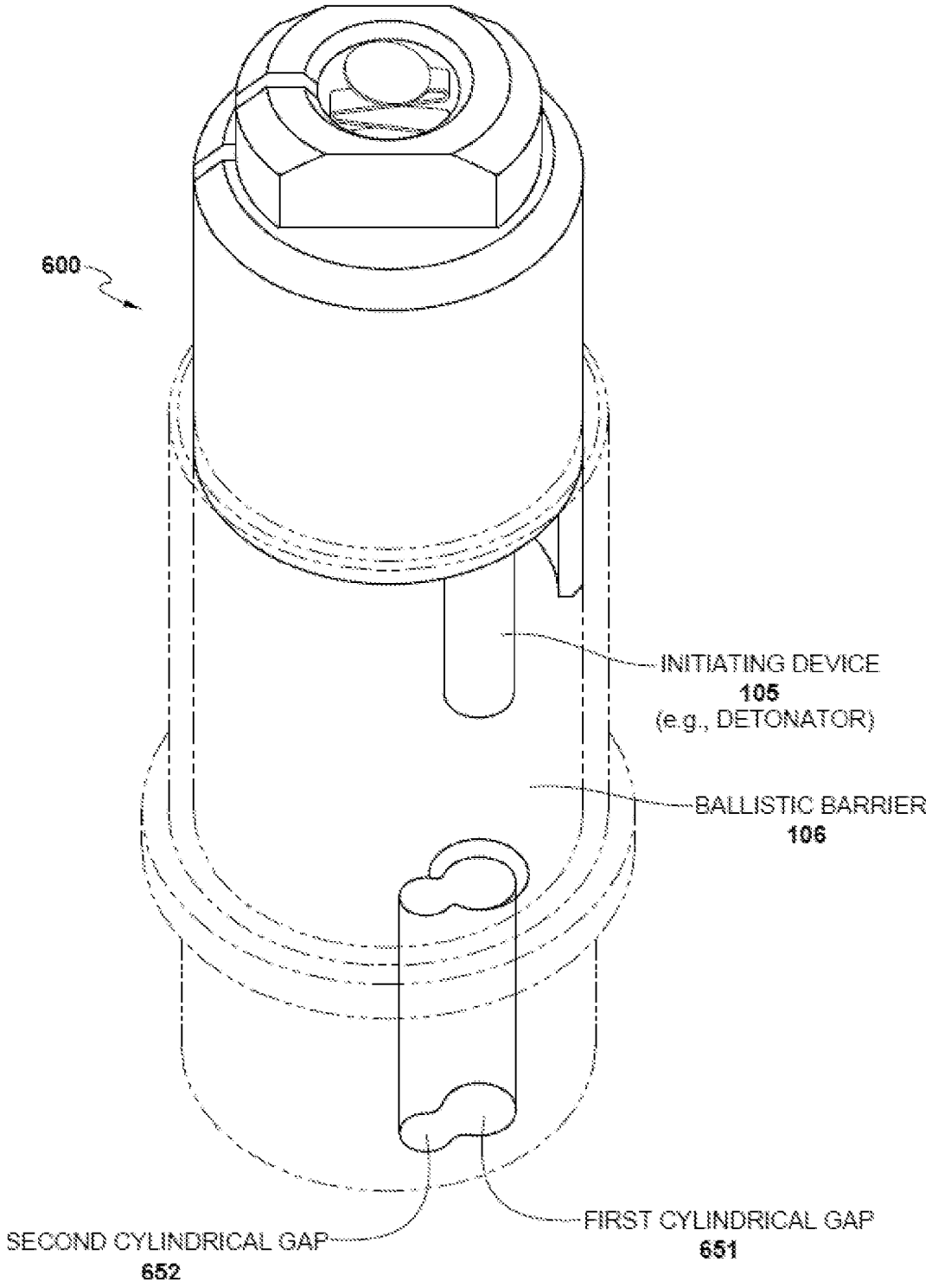
FIG. 6 depicts a schematic diagram of an example initiating device assembly including an initiating device and a ballistic barrier, according to some implementations.

FIG. 6 depicts a schematic diagram of an example initiating device assembly 600 including an initiating device 105 and a ballistic barrier 106. In some implementations, the initiating device assembly 600 may be within the carrier or housing of a well tool (e.g., such as the housing or carrier of a perforating gun system). In some implementations, when the first well tool (e.g., such as the first well tool 100) is engaged with a second well tool (e.g., such as the second well tool 110), the ballistic barrier is compressed or rotated (or it is moved in a different manner) to move the initiating device 105 into the first cylindrical gap 651 and move a detonating cord (such as the detonating cord 115) into the second cylindrical gap 652. The first cylindrical gap 651 and the second cylindrical gap 652 may have an opening at one end to allow the initiating device 105 to be aligned with the detonating cord 115. For example, the initiating device 105 may come in contact with the detonating cord 115 or may be positioned next to, or at close proximity to, the detonating cord 115 such that the detonation path is opened. It is noted, however, that the ballistic barrier 106 may function and mechanically move in various other ways to align the initiating device 105 with the detonating cord 115.

Figure 7:
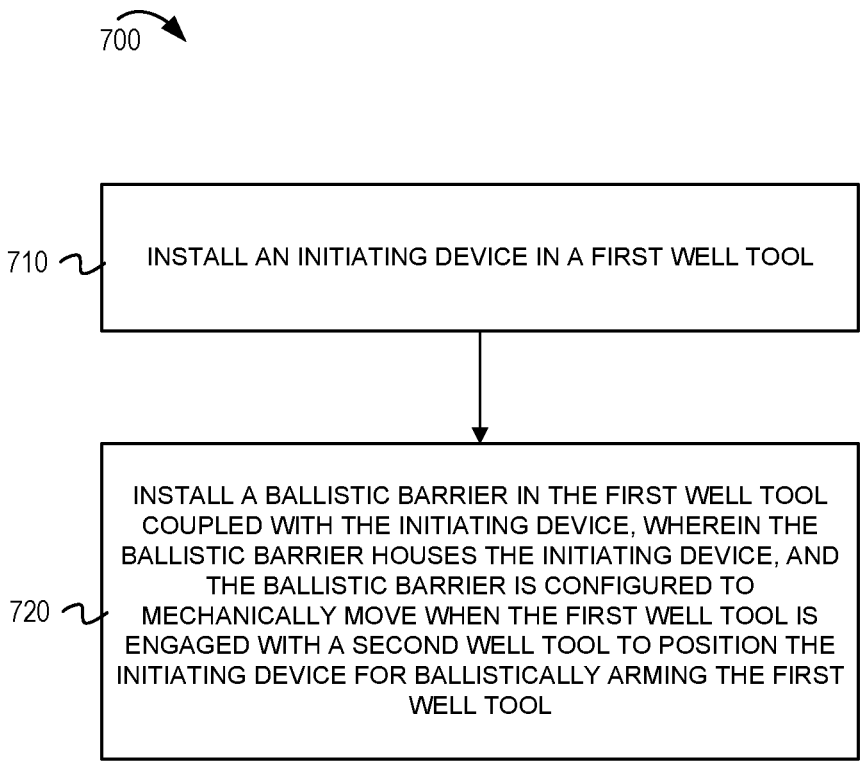
FIG. 7 is a flowchart of example operations for assembling a first well tool for use in a well system, according to some implementations.

FIG. 7 is a flowchart 700 of example operations for assembling a first well tool for use in a well system. The operations may include installing an initiating device in the first well tool (block 710). The operations may include installing a ballistic barrier in the first well tool coupled with the initiating device. The ballistic barrier may house the initiating device, and the ballistic barrier may be configured to mechanically move when the first well tool is engaged with a second well tool to position the initiating device for ballistically arming the first well tool (block 720).

In some implementations, the first well tool may be a first perforating gun system, an isolation tool, a connection tool, or a setting tool. In some implementations, the second well tool may be a second perforating gun system, an insolation tool, or a connection tool. In some implementations, the initiating device may be a detonator, an igniter, an initiator, or a blasting cap. In some implementations, the ballistic barrier may be configured to mechanically move when the first well tool is engaged with the second well tool to align the initiating device with a detonating cord of the second well tool for ballistically arming the first well tool. In some implementations, the ballistic barrier may be configured to provide an interruption barrier for a detonating path from the initiating device to a detonator cord, and the ballistic barrier may be configured to mechanically move when the first well tool is engaged with the second well tool to open the detonation path for ballistically arming the first well tool. In some implementations, the detonation path may include the initiating device of the first well tool and the detonator cord of the second well tool.

Figure 8:
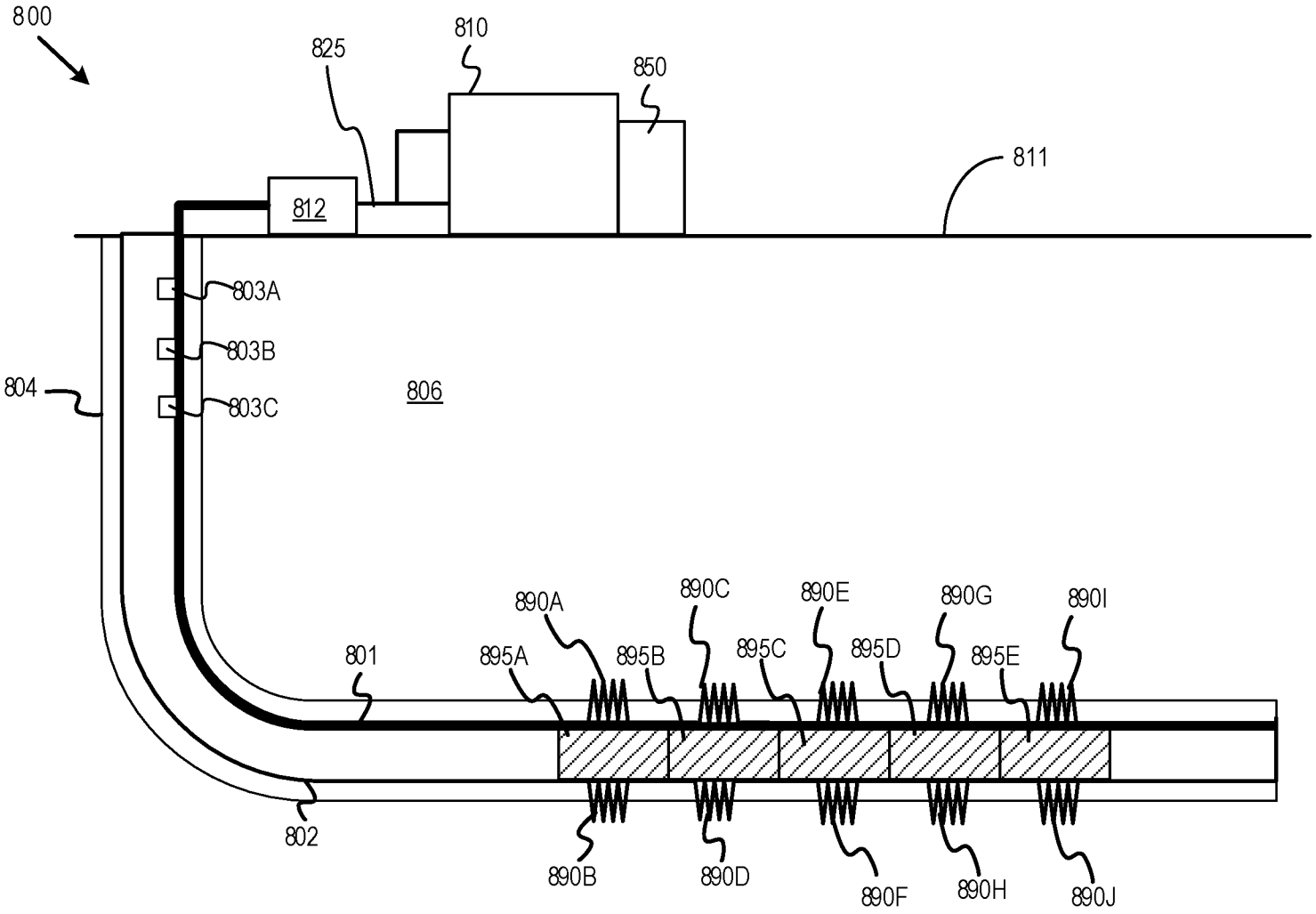
FIG. 8 is a schematic diagram of an example well system having perforating gun systems for performing fracturing operations, according to some implementations.

FIG. 8 is a schematic diagram of an example well system having perforating gun systems for performing fracturing operations, according to some implementations. A well system 800 may comprise a wellbore 804 in a subsurface formation 806. The wellbore 804 may include a casing 802 and a number of perforations 890A-890J being made in the casing 802 at different depths as part of hydraulic fracturing to allow hydraulic communication between the subsurface formation 806 and the casing 802 and to allow fracturing at different zones. The well system 800 may also include perforating gun systems 895A-895E, which may be representative of the first well tool 100 and the perforating gun systems described above in FIGS. 1-7. Each of the perforating gun systems 895A-895E may be assembled and ballistically armed as described above with reference to FIGS. 1-7. Also, each of the perforating gun systems 895A-895E may be configured to implement the features described above with reference to FIGS. 1-7.

In some implementations, the well system 800 also may include a fiber optic cable 801. The fiber optic cable 801 may be cemented in place in the annular space between the casing 802 of the wellbore 804 and the subsurface formation 806. In some implementations, the fiber optic cable 801 may be clamped to the outside of the casing 802 during deployment and protected by centralizers and cross coupling clamps. The fiber optic cable 801 may house one or more optical fibers, and the optical fibers may be single mode fibers, multi-mode fibers, or a combination of single mode and multi-mode optical fibers.

In some implementations, the fiber optic cable 801 may be used for distributed sensing where acoustic, strain, and temperature data may be collected. The data may be collected at various positions distributed along the fiber optic cable 801. For example, data may be collected every 1-3 ft along the full length of the fiber optic cable 801. The fiber optic cable 801 may be included with coiled tubing, wireline, loose fiber using coiled tubing, or gravity deployed fiber coils that unwind the fiber as the coils are moved in the wellbore 804. The fiber optic cable 801 also may be deployed with pumped down coils and/or self-propelled containers. Additional deployment options for the fiber optic cable 801 may include coil tubing and wireline deployed coils where the fiber optic cable 801 is anchored at the toe of the wellbore 804. In such embodiments, the fiber optic cable 801 may be deployed when the wireline or coiled tubing is removed from the wellbore 804. The distribution of sensors shown in FIG. 8 is for example purposes only. Any suitable sensor deployment may be used. For example, the well system 800 may include fiber optic cable deployed sensors or sensors cemented into the casing. Different types of sensors deployments also may be combined in a single well, such as including both sensors cemented to the casing and sensors in plugs, flow metering devices, etc. in a single well system.

In some implementations, a fiber optic interrogation unit 812 may be located on the surface 811 of the well system 800. The fiber optic interrogation unit 812 may be directly coupled to the fiber optic cable 801. Alternatively, the fiber optic interrogation unit 812 may be coupled to a fiber stretcher module, wherein the fiber stretcher module is coupled to the fiber optic cable 801. The fiber optic interrogation unit 812 may receive measurement values taken and/or transmitted along the length of the fiber optic cable 801 such as acoustic, temperature, strain, etc. The fiber optic interrogation unit 812 may be electrically connected to a digitizer to convert optically transmitted measurements into digitized measurements. The well system 800 may contain multiple sensors, such as sensors 803A-C. There may be any suitable number of sensors placed at any suitable location in the wellbore 804. The sensors 803A-C may include pressure sensors, distributed fiber optic sensors, point temperature sensors, point acoustic sensors, interferometric sensors or point strain sensors. Distributed fiber optic sensors may be capable of measuring distributed acoustic data, distributed temperature data, and distributed strain data. Any of the sensors 803A-C may be communicatively coupled (not shown) to other components of the well system 800 (e.g., the computer 810). In some implementations, the sensors 803A-C may be cemented to a casing 802.

In some implementations, a computer 810 may receive the electrically transmitted measurements from the fiber optic interrogation unit 812 using a connector 825. The computer 810 may include a signal processor to perform various signal processing operations on signals captured by the fiber optic interrogation unit 812 and/or other components of the well system 800. The computer 810 may have one or more processors and a memory device to analyze the measurements and graphically represent analysis results on the display device 850.

In some implementations, the fiber optic interrogation unit 812 may operate using various sensing principles including but not limited to amplitude-based sensing systems like Distributed Temperature Sensing (DTS), DAS, Distributed Vibration Sensing (DVS), and Distributed Strain Sensing (DSS). For example, the DTS system may be based on Raman and/or Brillouin scattering. A DAS system may be a phase sensing-based system based on interferometric sensing using homodyne or heterodyne techniques where the system may sense phase or intensity changes due to constructive or destructive interference. The DAS system may also be based on Rayleigh scattering and, in particular, coherent Rayleigh scattering. A DSS system may be a strain sensing system using dynamic strain measurements based on interferometric sensors (e.g., sensors 803A-C) or static strain sensing measurements using Brillouin scattering. DAS systems based on Rayleigh scattering may also be used to detect dynamic strain events. Temperature effects may in some cases be subtracted from both static and/or dynamic strain events, and temperature profiles may be measured using Raman based systems and/or Brillouin based systems capable of differentiating between strain and temperature, and/or any other optical and/or electronic temperature sensors, and/or any other optical and/or electronic temperature sensors, and/or estimated thermal events.

In some implementations, the fiber optic interrogation unit 812 may measure changes in optical fiber properties between two points in the optical fiber at any given point, and these two measurement points move along the optical sensing fiber as light travels along the optical fiber. Changes in optical properties may be induced by strain, vibration, acoustic signals and/or temperature as a result of the fluid flow. Phase and intensity based interferometric sensing systems may be sensitive to temperature and mechanical, as well as acoustically induced, vibrations. The fiber optic interrogation unit 812 may capture DAS data in the time domain. One or more components of the well system 800 may convert the DAS data from the time domain to frequency domain data using Fast Fourier Transforms (FFT) and other transforms. For example, wavelet transforms may also be used to generate different representations of the DAS data. Various frequency ranges may be used for different purposes and where low frequency signal changes may be attributed to formation strain changes or fluid movement and other frequency ranges may be indicative of fluid or gas movement. Various filtering techniques may be applied to generate indicators of events related to measuring the flow of fluid.

In some implementations, DAS measurements along the wellbore 804 may be used as an indication of fluid flow through the casing 802 in the wellbore 804. Vibrations and/or acoustic profiles may be recorded and stacked over time, where a simple approach could correlate total energy or recorded signal strength with known flow rates. For example, the fiber optic interrogation unit 812 may measure energy and/or amplitude in multiple frequency bands where changes in select frequency bands may be associated with oil, water and/or gas thus enabling multiphase production profiling along the wellbore 804.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for reservoir modeling as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE EMBODIMENTS

Example Embodiments can include the following:

Embodiment #1: A first well tool, comprising: an initiating device; and a ballistic barrier housing the initiating device, the ballistic barrier configured to mechanically move when the first well tool is engaged with a second well tool to position the initiating device for ballistically arming the first well tool.

Embodiment #2: The first well tool of Embodiment #1, wherein: the first well tool is a first perforating gun system, an isolation tool, a connection tool, or a setting tool; and the second well tool is a second perforating gun system, an insolation tool, or a connection tool.

Embodiment #3: The first well tool of Embodiment #1, wherein the initiating device is a detonator, an igniter, an initiator, or a blasting cap.

Embodiment #4: The first well tool of Embodiment #1, wherein the ballistic barrier is configured to mechanically move when the first well tool is engaged with the second well tool to align the initiating device with a detonating cord of the second well tool for ballistically arming the first well tool.

Embodiment #5: The first well tool of Embodiment #1, wherein the ballistic barrier is configured to provide an interruption barrier for a detonating path from the initiating device to a detonator cord, and the ballistic barrier is configured to mechanically move when the first well tool is engaged with the second well tool to open the detonation path for ballistically arming the first well tool.

Embodiment #6: The first well tool of Embodiment #5, wherein the detonation path includes the initiating device of the first well tool and the detonator cord of the second well tool.

Embodiment #7: The first well tool of Embodiment #1, wherein the ballistic barrier being configured to mechanically move includes the ballistic barrier being configured to retract, compress, rotate, or slide when the first well tool is engaged with the second well tool.

Embodiment #8: The first well tool of Embodiment #1, wherein the ballistic barrier is configured to mechanically move to remove the initiating device from a detonation path when the first well tool is disengaged from the second well tool to ballistically disarm the first well tool.

Embodiment #9: A first perforating gun system, comprising: a detonator; and a ballistic barrier housing the detonator, the ballistic barrier configured to mechanically move when the first perforating gun system is engaged with a second perforating gun system to position the detonator for ballistically arming the first perforating gun system.

Embodiment #10: The first perforating gun system of Embodiment #9, wherein the ballistic barrier is configured to mechanically move when the first perforating gun system is engaged with the second perforating gun to align the detonator with a detonating cord of the second perforating gun system for ballistically arming the first perforating gun system.

Embodiment #11: The first perforating gun system of Embodiment #9, wherein the ballistic barrier is configured to provide an interruption barrier for a detonating path from the detonator to a detonator cord, and the ballistic barrier is configured to mechanically move when first perforating gun system is engaged with the second perforating gun system to open the detonation path for ballistically arming the first perforating gun system.

Embodiment #12: The first perforating gun system of Embodiment #11, wherein the second perforating gun system includes one or more charges, and the detonation path includes the detonator of the first perforating gun system, the detonating cord of the second perforating gun system, and the one or more charges of the second perforating gun system.

Embodiment #13: The first perforating gun system of Embodiment #9, wherein the ballistic barrier being configured to mechanically move includes the ballistic barrier being configured to retract, compress, rotate, or slide when the first perforating gun system is engaged with the second perforating gun system.

Embodiment #14: The first perforating gun system of Embodiment #9, wherein the ballistic barrier is configured to mechanically move to remove the detonator from a detonation path when the first perforating gun system is disengaged from the second perforating gun system to ballistically disarm the first perforating gun system.

Embodiment #15: The first perforating gun system of Embodiment #9, further comprises: a charge tube assembly including one or more charges; and a bulkhead positioned between the charge tube assembly and the ballistic barrier and detonator.

Embodiment #16: A method for assembling a first well tool for use in a well system, the method comprising: installing an initiating device in the first well tool; and installing a ballistic barrier in the first well tool coupled with the initiating device, wherein the ballistic barrier houses the initiating device, and the ballistic barrier is configured to mechanically move when the first well tool is engaged with a second well tool to position the initiating device for ballistically arming the first well tool.

Embodiment #17: The method of Embodiment #16, wherein: the first well tool is a first perforating gun system, an isolation tool, a connection tool, or a setting tool; the second well tool is a second perforating gun system, an insolation tool, or a connection tool; and the initiating device is a detonator, an igniter, an initiator, or a blasting cap.

Embodiment #18: The method of Embodiment #16, wherein the first well tool is a first perforating gun system, the second well tool is a second perforating gun system, and the initiating device is a detonator.

Embodiment #19: The method of Embodiment #16, wherein the ballistic barrier is configured to mechanically move when the first well tool is engaged with the second well tool to align the initiating device with a detonating cord of the second well tool for ballistically arming the first well tool.

Embodiment #20: The method of Embodiment #16, wherein the ballistic barrier is configured to provide an interruption barrier for a detonating path from the initiating device to a detonator cord, and the ballistic barrier is configured to mechanically move when the first well tool is engaged with the second well tool to open the detonation path for ballistically arming the first well tool.

What is claimed is:

1. A first well tool, comprising:

an initiating device; and a ballistic barrier, the ballistic barrier housing the initiating device within the ballistic barrier, the ballistic barrier configured to block detonation by interrupting a detonation path from the initiating device to a detonator cord, and the ballistic barrier configured to mechanically move when the first well tool is engaged with a second well tool to position the initiating device for ballistically arming the first well tool.

2. The first well tool of claim 1, wherein:

the first well tool is a first perforating gun system, an isolation tool, a connection tool, or a setting tool; and the second well tool is a second perforating gun system, an isolation tool, or a connection tool.

3. The first well tool of claim 1, wherein the initiating device is a detonator, an igniter, an initiator, or a blasting cap.

4. The first well tool of claim 1, wherein the ballistic barrier is configured to mechanically move when the first well tool is engaged with the second well tool to align the initiating device with the detonating cord of the second well tool for ballistically arming the first well tool.

5. The first well tool of claim 1, wherein the ballistic barrier is configured to provide an interruption barrier for the detonating path from the initiating device to the detonator cord, and the ballistic barrier is configured to mechanically move when the first well tool is engaged with the second well tool to open the detonation path for ballistically arming the first well tool.

6. The first well tool of claim 5, wherein the detonation path includes the initiating device of the first well tool and the detonator cord of the second well tool.

7. The first well tool of claim 1, wherein the ballistic barrier being configured to mechanically move includes the ballistic barrier being configured to retract, compress, rotate, or slide when the first well tool is engaged with the second well tool.

8. The first well tool of claim 1, wherein the ballistic barrier is configured to mechanically move to remove the initiating device from the detonation path when the first well tool is disengaged from the second well tool to ballistically disarm the first well tool.

9. The first well tool of claim 1, wherein the ballistic barrier is configured to provide an electrical barrier for an electrical path to block electrical signals that trigger detonation and electrically disarm the first well tool.

10. The first well tool of claim 1, wherein the ballistic barrier includes a barrier window, wherein the ballistic barrier is configured to mechanically move when the first well tool is engaged with the second well tool to align the initiating device with the detonating cord via the barrier window for ballistically arming the first well tool, wherein, when the ballistic barrier mechanically moves, the barrier window of the ballistic barrier also moves to a position between the initiating device and the detonating cord to open the detonation path from the initiating device to the detonator cord.

11. The first well tool of claim 1, wherein the initiating device is configured to mechanically move when the first well tool is engaged with the second well tool to align with the detonating cord of the second well tool to open the detonation path for ballistically arming the first well tool.

12. A first perforating gun system, comprising:

a detonator; and a ballistic barrier, the ballistic barrier housing the detonator within the ballistic barrier, the ballistic barrier configured to block detonation by interrupting a detonation path from the detonator to a detonator cord, and the ballistic barrier configured to mechanically move when the first perforating gun system is engaged with a second perforating gun system to position the detonator for ballistically arming the first perforating gun system.

13. The first perforating gun system of claim 12, wherein the ballistic barrier is configured to mechanically move when the first perforating gun system is engaged with the second perforating gun system to align the detonator with the detonating cord of the second perforating gun system for ballistically arming the first perforating gun system.

14. The first perforating gun system of claim 12, wherein the ballistic barrier is configured to provide an interruption barrier for the detonating path from the detonator to the detonator cord, and the ballistic barrier is configured to mechanically move when the first perforating gun system is engaged with the second perforating gun system to open the detonation path for ballistically arming the first perforating gun system.

15. The first perforating gun system of claim 14, wherein the second perforating gun system includes one or more charges, and the detonation path includes the detonator of the first perforating gun system, the detonating cord of the second perforating gun system, and the one or more charges of the second perforating gun system.

16. The first perforating gun system of claim 12, wherein the ballistic barrier being configured to mechanically move includes the ballistic barrier being configured to retract, compress, rotate, or slide when the first perforating gun system is engaged with the second perforating gun system.

17. The first perforating gun system of claim 12, wherein the ballistic barrier is configured to mechanically move to remove the detonator from the detonation path when the first perforating gun system is disengaged from the second perforating gun system to ballistically disarm the first perforating gun system.

18. The first perforating gun system of claim 12, further comprises:

a charge tube assembly including one or more charges; and a bulkhead positioned between the charge tube assembly and the ballistic barrier and the detonator.

19. A method for assembling a first well tool for use in a well system, the method comprising:

installing an initiating device in the first well tool; and installing a ballistic barrier in the first well tool coupled with the initiating device, wherein the ballistic barrier houses the initiating device within the ballistic barrier, the ballistic barrier is configured to block detonation by interrupting a detonation path from the initiating device to a detonator cord, and the ballistic barrier is configured to mechanically move when the first well tool is engaged with a second well tool to position the initiating device for ballistically arming the first well tool.

20. The method of claim 19, wherein:

the first well tool is a first perforating gun system, an isolation tool, a connection tool, or a setting tool;

the second well tool is a second perforating gun system, an isolation tool, or a connection tool; and the initiating device is a detonator, an igniter, an initiator, or a blasting cap.

21. The method of claim 19, wherein the first well tool is a first perforating gun system, the second well tool is a second perforating gun system, and the initiating device is a detonator.

22. The method of claim 19, wherein the ballistic barrier is configured to mechanically move when the first well tool is engaged with the second well tool to align the initiating device with the detonating cord of the second well tool for ballistically arming the first well tool.

23. The method of claim 19, wherein the ballistic barrier is configured to provide an interruption barrier for the detonating path from the initiating device to the detonator cord, and the ballistic barrier is configured to mechanically move when the first well tool is engaged with the second well tool to open the detonation path for ballistically arming the first well tool.

* * * * *